US005984016A

United States Patent [19]

Samuelsson

[11] Patent Number: 5,984,016

[45] Date of Patent: Nov. 16, 1999

[54] FIRE EXTINGUISHER FOR CLOSED SPACES

[75] Inventor: Kennerth Samuelsson, Växjö , Sweden

[73] Assignee: Teknikbolaget AB, Vaxjo, Sweden

[21] Appl. No.: 08/952,103

[22] PCT Filed: Apr. 10, 1996

[86] PCT No.: PCT/SE96/00461

§ 371 Date: Jan. 22, 1998

§ 102(e) Date: Jan. 22, 1998

[87] PCT Pub. No.: WO96/36398

PCT Pub. Date: Nov. 21, 1996

[30] Foreign Application Priority Data

May 18, 1995 [SE] Sweden ..... 95018-46

[51] Int. Cl.[6] ..... A62C 3/07

[52] U.S. Cl. ..... 169/62; 169/73; 169/9

[58] Field of Search ..... 169/9, 21, 22, 169/26, 33, 56–58, 62, 66, 71–73, 85; 222/386.5, 389; 137/206, 209

[56] References Cited

U.S. PATENT DOCUMENTS

| | | | |
|---|---|---|---|
| 1,939,333 | 12/1933 | Broander | 169/73 |
| 2,001,207 | 5/1935 | McManamna | 169/73 |
| 2,459,743 | 1/1949 | Trainer et al. | 169/73 |
| 2,804,929 | 9/1957 | Plummer | 169/73 |
| 2,808,114 | 10/1957 | Parker, Jr. et al. | 169/73 |
| 3,030,063 | 4/1962 | Seaberg et al. | 169/9 |
| 3,474,769 | 10/1969 | Millen | 169/57 |
| 3,515,218 | 6/1970 | Gardner et al. | 169/62 |
| 3,583,491 | 6/1971 | Lindeberg | 169/73 |
| 3,773,111 | 11/1973 | Dunn | 169/33 |
| 4,194,572 | 3/1980 | Thery et al. | 169/9 |
| 4,889,189 | 12/1989 | Rozniecki | 169/73 |
| 5,660,236 | 8/1997 | Sears et al. | 169/72 |
| 5,664,631 | 9/1997 | Szocs | 169/71 |
| 5,676,210 | 10/1997 | Sundholm | 169/9 |
| 5,806,601 | 9/1998 | Sundholm | 169/9 |

FOREIGN PATENT DOCUMENTS

| | | |
|---|---|---|
| 848954 | 11/1939 | France . |
| 500287 | 5/1994 | Sweden . |
| WO 92/22353 | 12/1992 | WIPO . |
| WO 93/10859 | 6/1993 | WIPO . |

*Primary Examiner*—Andres Kashnikow
*Assistant Examiner*—Lisa Ann Douglas
*Attorney, Agent, or Firm*—Baker & Daniels

[57] ABSTRACT

A fire extinguisher for closed spaces comprising a pressure container having at least two chambers separated from each other by means of a displaceable wall, one of the chambers containing an extinguishant liquid and being provided with a release valve and the other chamber containing a pressurized driving gas for discharging the extinguishant liquid from said one chamber through said release valve by displacing the displaceable wall into the first chamber at a high pressure when the release valve is actuated, the fire extinguisher further comprising at least one nozzle connected with the release valve for atomizing the extinguishant liquid supplied to the nozzle from the release valve at a high pressure in order to create a liquid fog filling the closed space, characterized in that the displaceable wall is constituted by a piston displaceably positioned in the pressure container between the chamber containing the extinguishant liquid and the chamber containing the pressurized driving gas, the piston being adapted to discharge the whole amount of extinguishant liquid independent of the fire extinguisher.

20 Claims, 8 Drawing Sheets

FIRE EXTINGUISHER FOR CLOSED SPACES

The present invention relates to a fire extinguisher for closed spaces.

In a previously known type of a fire extinguisher for closed spaces there is used halon which from the fire extinguisher is supplied to the closed space and displaces the oxygen therefrom so that a rapid and effective fire extinguishing is obtained also in respect of fires in oil, petrol, solvents and electric systems. Fire extinguishers working with halon are extremely effective for extinguishing fires in closed spaces, such as in the motor space of vehicles and boats. Especially in racing cars the use of fire extinguishers working with halon has found an extended use. A drawback of fire extinguishers working with halon is the fact that halon destroys the ozone layer of the earth. It has therefore been decided on an international basis that the use of fire extinguishers working with halon shall be terminated within the next few years.

In addition to fire extinguishers working with halon it is previously known to use fire extinguishers working with powder or carbon dioxide snow for extinguishing fires in closed spaces. Fire extinguishers working with powder are effective but a drawback is that the powder extends over large areas and penetrates into small spaces in such a way that a decontamination is difficult to conduct. Powder from a powder extinguisher can also provide damages to for example a hot motor at a fire in a vehicle, and subsequent to extinguishing a fire in a motor space it is necessary completely to recondition the motor of the vehicle because of powder which has penetrated the motor at different locations.

The use of fire extinguishers working with carbon dioxide snow is dangerous for reasons of health, and the spraying of carbon dioxide snow at a fire in for example the driving compartment of a vehicle can lead to serious damages or even to the death for persons present in the driving compartment.

Certain prior art fire extinguishers of another type than fire extinguishers working with halon require that the fire extinguishers take a certain position to work in a correct way. Of course, this is a drawback if a fire brakes out in a vehicle which ends up upside-down, in which case a fire extinguisher of this kind is not completely emptied.

The object of the invention is to provide a fire extinguisher for closed spaces having the same good properties as a fire extinguisher working with halon without causing the risk for damages to the environment and persons, provided by the use of halon.

In order to comply with this object the fire extinguisher according to the invention is characterized by a pressure container having a release valve and containing in association with the release valve a extinguishant liquid, the container having at the opposite side from the extinguishant liquid in relation to the release valve a pressurized driving gas for discharging the extinguishant liquid from the pressure container at a high pressure when the release valve is activated, and by at least one nozzle connected with the release valve for atomizing the extinguishant liquid supplied to the nozzle from the release valve at a high pressure for creating a liquid fog filling up the closed space.

The liquid fog created by the fire extinguisher according to the invention is capable of filling up a closed space in which a fire has broken out and to displace the oxygen in the space, the liquid fog having at the same time a cooling action. By the displacement of the oxygen and the cooling action the fire broken out in the closed space is extinguished also in the case that extremely flammable materials, such as oil, petrol, solvents and the like have caught fire.

It is suitable that the extinguishant liquid is constituted by water, the fire extinguisher creating when it is activated a liquid fog consisting of water. The use of water has the advantage that the water is friendly to the environments, unharmful to people and animals and cheap. It is possible to add to the water an agent reducing the surface tension, for example a tenside, which provides for a further improvement of the efficiency of the extinguishing action and obstruct re-ignition.

Preferably the pressure container of the fire extinguisher comprises two chambers separated from each other by means of a displaceable wall, one of the chambers being positioned in connection with the release valve and containing the extinguishant liquid and the other chamber containing the pressurized driving gas, the pressurized driving gas driving out the extinguishant liquid through the release valve by displacement of the moveable wall into the first chamber at a high pressure when the release valve is activated. A fire extinguisher designed in this way according to the invention discharges its whole amount of extinguishant liquid independent of the position of the fire extinguisher. Thus, there is in this embodiment of the fire extinguisher according to the invention provided a complete discharge of the extinguishant liquid even if the fire extinguisher is positioned in a vehicle taking an upside-down position.

The displaceable wall separating the chamber containing extinguishant liquid from the chamber containing pressurized driving gas can be constituted by a piston which is displaceably arranged in the pressure container but can also be constituted by a diaphragm. In an alternative embodiment of the fire extinguisher the diaphragm can be formed as a bladder constituting the chamber which contains the pressurized driving gas.

The fire extinguisher according to the invention can also be designed so that the pressure container of the fire extinguisher comprises two chambers for extinguishant liquid each provided with one release valve and a chamber for the pressurized driving gas, positioned between these chambers and separated therefrom by means of displaceable walls, wherein it is possible to supply the two chambers for extinguishant liquid with different amounts of extinguishant liquid with regard to the size of the closed space, with which the different chambers are connected.

In a fire extinguisher according to the invention it is desirable that the extinguishant liquid is at the activation of the fire extinguisher atomized to a liquid fog having a droplet size of 15–80 $\mu$. In order to provide a droplet size of this magnitude it is necessary that the extinguishant liquid and the pressurized driving gas have during the emptying phase an average pressure of 70 bar which means that the charging pressure prior to the activation of the release valve must amount to about 100 bar. This high pressure puts high requirements on the design of the release valve with regard to the capacity of the valve to close the chamber containing the extinguishant liquid as well as to provide at the activation of the fire extinguisher a rapid and secure discharge of the extinguishant liquid. A release valve which fulfills these requirements comprises a discharge opening which is closed by means of a diaphragm supported by a displaceable support element at the opposite side from the chamber for extinguishant liquid, the support element being adapted at the activation of the release valve to be displaced from the position supporting the diaphragm and the diaphragm being adapted in the position in which it is not supported by the support element to be ruptured by the pressure of the extinguishant liquid, whereupon the extinguishant liquid is discharged from the pressure container through the discharge opening of the release valve. Thereby, the support element of the release valve can be constituted by a piston which is displaceably journalled in the release valve and which by means of an end surface contacts the diaphragm in the position in which it supports the diaphragm.

The invention shall be described in the following with reference to the accompanying drawings.

Figure 8:
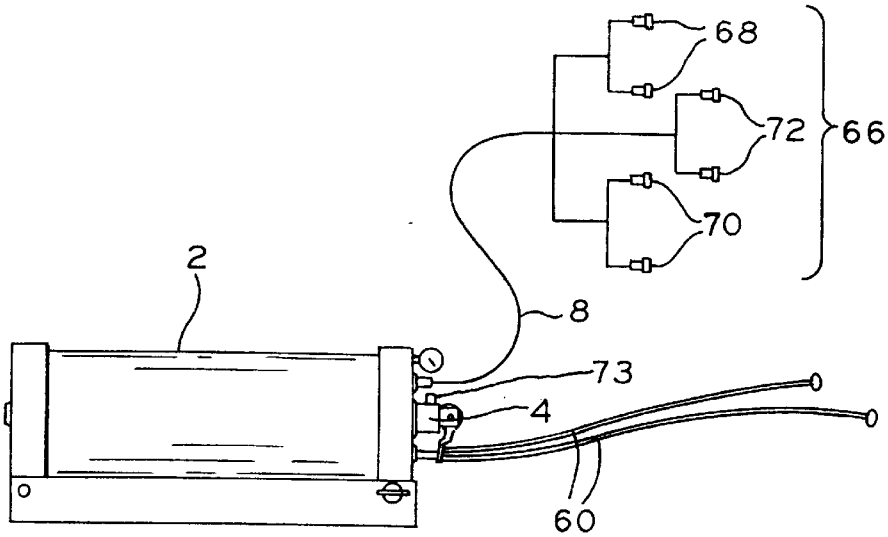

FIG. 8 schematically shows the design of a fire extinguisher according to the invention intended for vehicles.

Figure 9A:
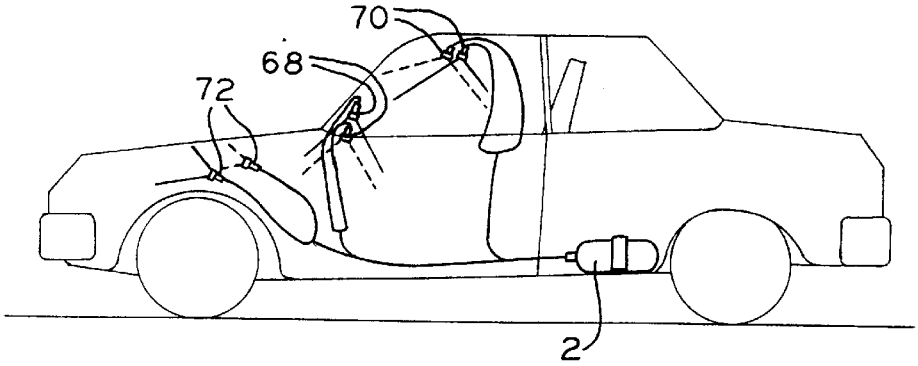
Figure 9B:
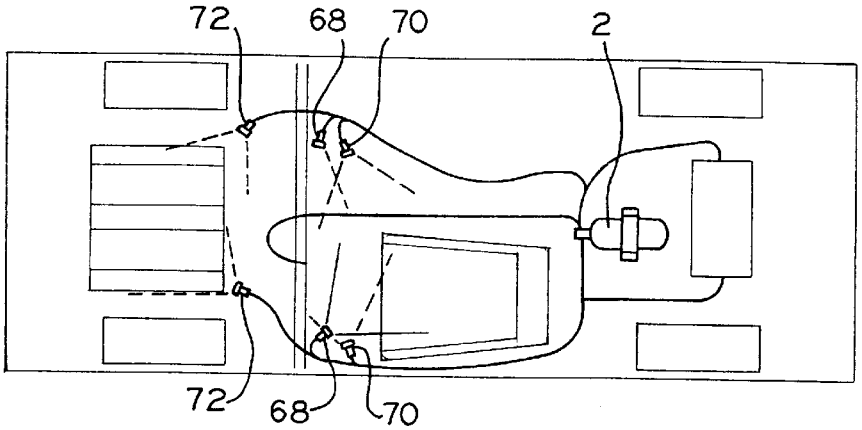

FIGS. 9*a* and 9*b* shows a side view and a plan view of a vehicle provided with fire extinguishers according to FIG. 8.

Figure 10:
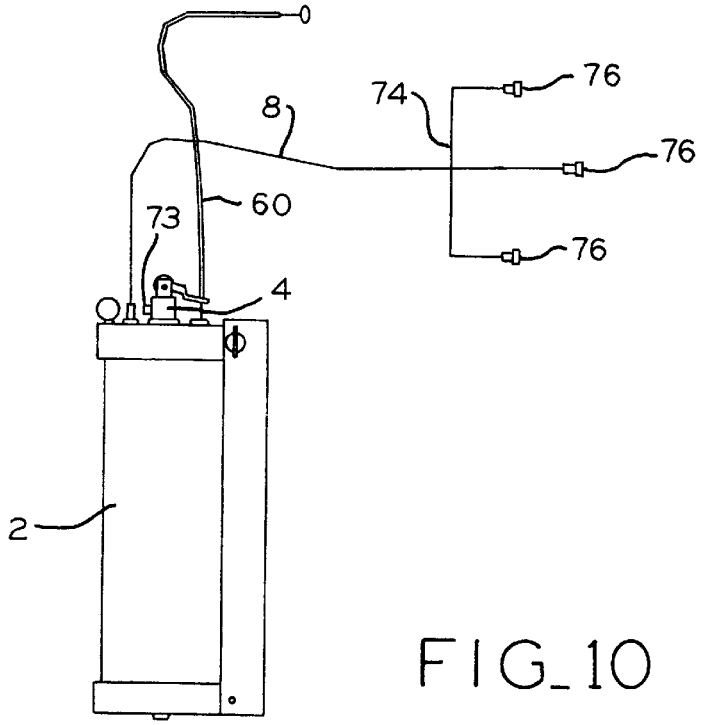

FIG. 10 is a schematically view of a fire extinguisher designed for a motor space of a boat.

Figure 11:
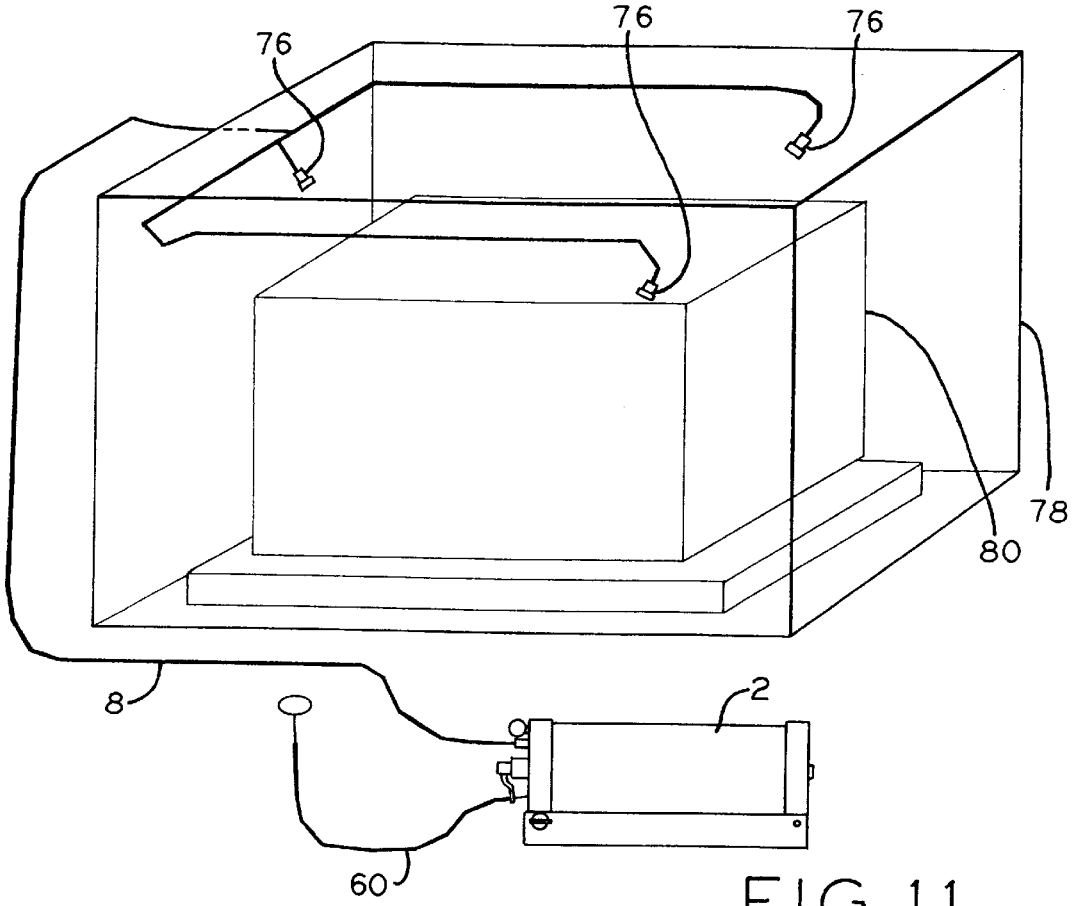

FIG. 11 shows the installation of the fire extinguisher shown in FIG. 10 in the motor compartment of a boat.

Figure 1:
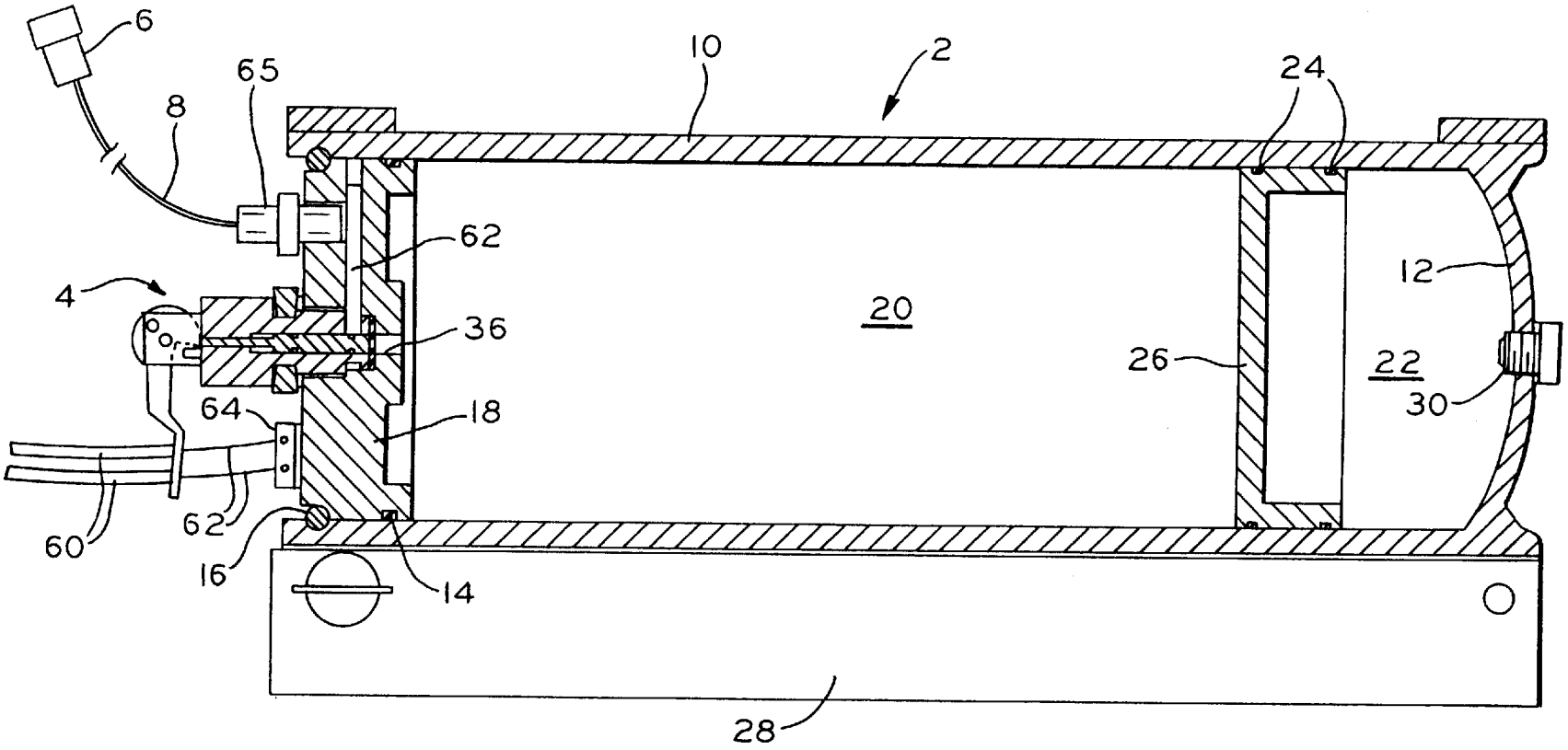
FIG. 1 is an axial section of an embodiment of a fire extinguisher according to the invention in a charged but not activated position.
Figure 2:
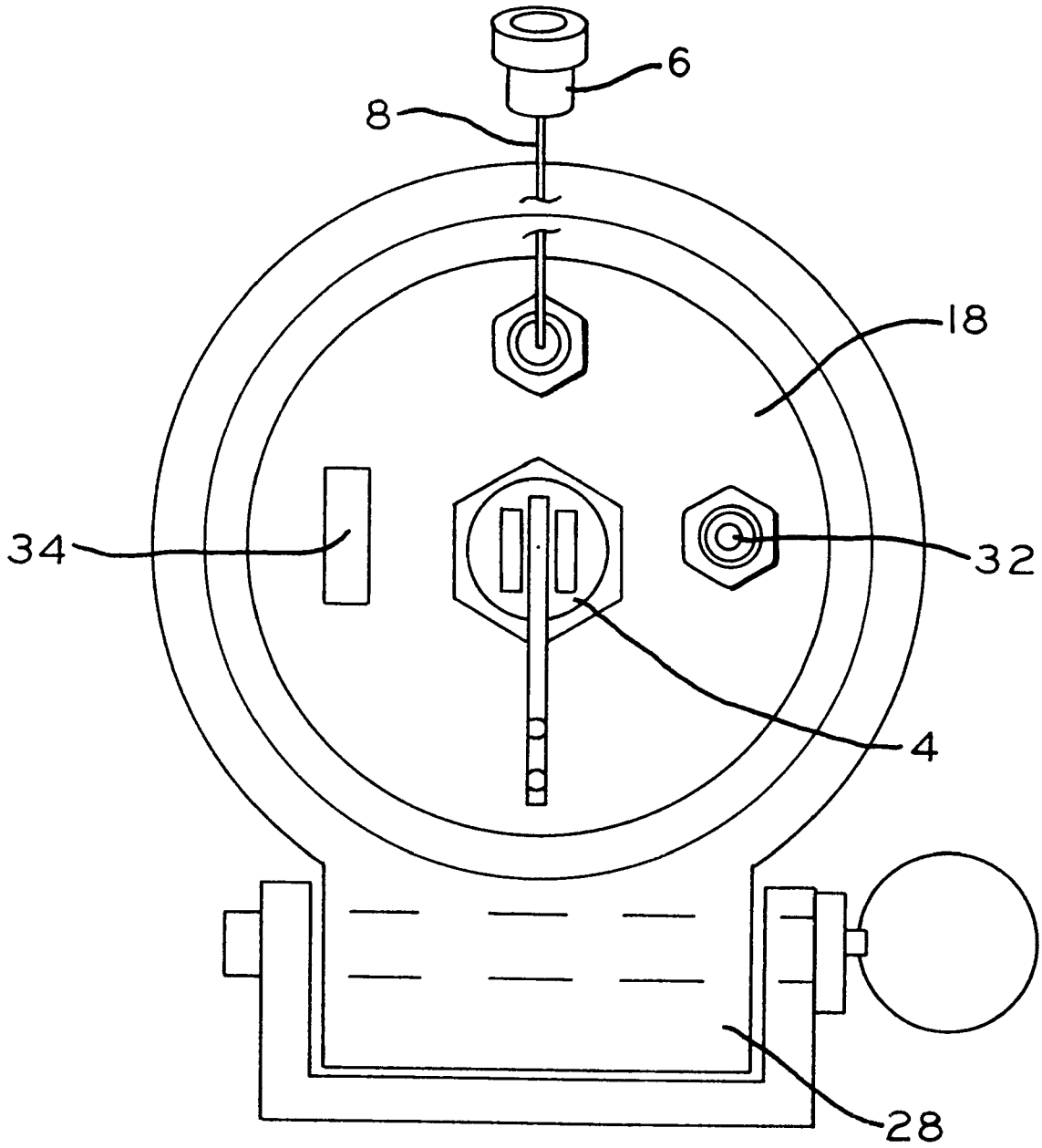
FIG. 2 is an end view of the fire extinguisher according to FIG. 1.

The embodiment of a fire extinguisher according to the invention shown in axial section in FIG. 1 comprises a pressure container 2, a release valve 4 and a nozzle 6 which is connected with the release valve by means of a conduit 8. The pressure container 2 consists of a cylindrical wall 10 having a fixed end wall 12 and an end wall 18 connected with the cylindrical wall 10 by means of a sealing ring 14 and a locking ring 16.

The pressure container 2 forms two chambers, a first chamber 20 for extinguishant liquid and a second chamber 22 for a driving gas. The chambers 20 and 22 are separated from each other by means of a piston 26 displaceably arranged in the pressure container and sealed with regard to the cylindrical wall 10 by means of sealing rings 24.

The fire extinguisher has a fastening device 28 which is connected with the pressure container 2 and which can be constructed with regard to the intended use of the fire extinguisher and is therefore not described in detail.

The end wall 12 is provided with a charging valve 30 for driving gas, while the end wall 18 is provided with a charging valve 30 for extinguishant liquid and is in addition thereto provided with a pressure gauge 34 showing the pressure in the pressure container 2.

The extinguishant liquid in the chamber 20 substantially consists of water possibly with the addition of a tenside lowering the surface tension of the water for giving a sticky covering surface on burning materials or objects according to the same principles as in foam extinguishing. The foam efficiently prevents re-ignition. It is also possible to add to the water an emulsion providing that the water is at the extinguishing of a fire in a burning liquid mixed with the liquid thereby preventing re-ignition. The driving gas in the chamber 22 is constituted by nitrogen, but it is of course possible to use any other suitable gas as a driving gas.

The fire extinguisher is suitably charged to a pressure of at least 100 bar by initially supplying driving gas through the charging valve 30 to a pressure of about 20 bar, the piston 26 thereby being displaced to a position adjacent to the end wall 18 and the gas filling the whole pressure container, whereupon extinguishant liquid is supplied through the charging valve 30 until the pressure in the pressure container has reached at least about 100 bar, when the piston 26 has been displaced to the position shown in FIG. 1 and the driving gas has consequently been compressed in the chamber 22. After charging in this way the fire extinguisher contains 80% extinguishant liquid and 20% driving gas, counted on the volume.

After charging but prior to activation the fire extinguisher has the appearance shown in FIG. 1.

Figure 3:
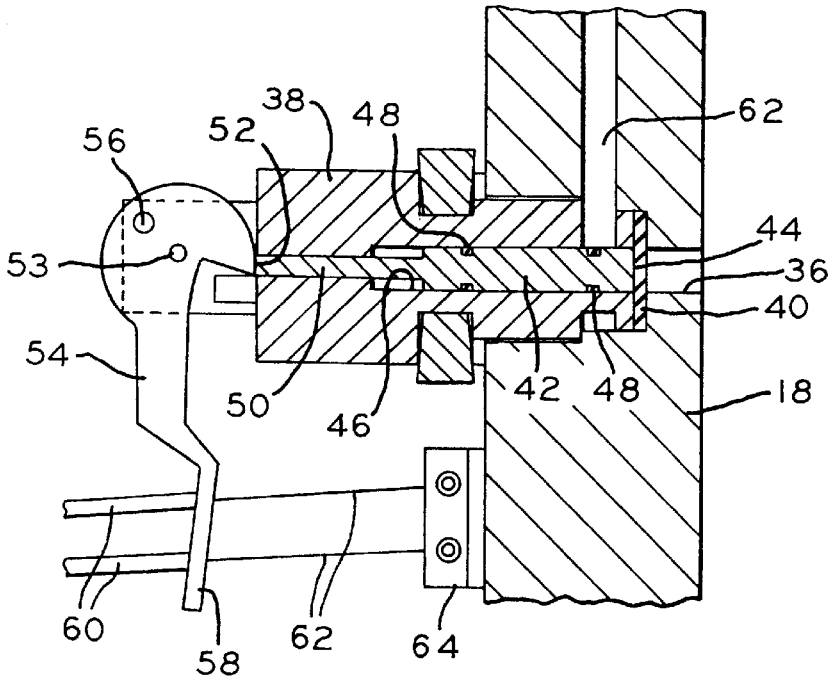
FIG. 3 is an axial section on an enlarged scale of a release valve of the fire extinguisher according to FIGS. 1 and 2.

The release valve 4 which is shown on an enlarged scale in FIG. 3 has a valve body 38 connected with an outlet opening 36 in the end wall 18 and screwed into the end wall 18. Between an inner end surface of the valve body 38 and an opposite surface of the end wall there is tensioned a diaphragm 40 of a soft material, for example rubber or plastic, which possibly can be reinforced in any suitable way and is adapted to close the outlet opening 36. The diaphragm 40 is supported at its side opposite from the chamber 20 by means of a piston 42 displaceably journalled in the valve body 38 and engaging the diaphragm with an end surface 44. The piston is displaceably journalled in a bore 46 in the valve body 38 and is sealed in relation to the wall of the bore 46 by means of sealing rings 48.

The piston 42 has a piston rod 50 which at its free end surface engages a locking surface 52 of a release lock 54 which is rotatably journalled on a shaft pin 53. Thus, when the fire extinguisher is in a non-activated condition the piston 42 is secured in its position supporting the diaphragm 40 by means of the release lock 54 which during transportation and prior to installation of the fire extinguisher is in turn secured by means of transport safety device 56. The release lock 54 comprises a control lever 58 to which release wires are connected. The inner threads 62 of the release wires are connected with an attachment 64 on the end wall 18. Because of the fact that the shaft pin 53 is according to FIGS. 3 and 5 displaced upwards from the axis of the piston road 50 there is provided a pretension of the release lock 54 towards the secured position of the piston 42.

In the end wall 18 there is after the release valve 4 provided a discharge channel 62. To the discharge channel 62 there is connected a discharge stud 65 with which the conduit 8 is connected. The nozzle 6 connected with the conduit 8 is of a design known per se and is of such a kind that the nozzle is at the supply of liquid from the conduit 8 at the pressures at which the fire extinguisher according to the invention is intended to work capable of atomizing the liquid to a liquid fog having a droplet size which preferably is within the range of 15–80 $\mu$m.

When the fire extinguisher is activated which can be provided either manually by operating any of the release wires 60 which can extend to different places or by means of an alternative device detecting the presence of heat and/or smoke, the lever 58 of the release lock 54 is turned counter clockwise, the locking surface 52 thereby being displaced out of engagement with the free end surface of the piston road 50. Thereby, the support of the diaphragm 40 by the support surface 44 of the piston 42 is interrupted causing the diaphragm 40 to be forced inwardly from the chamber 20 by the pressure of the extinguishant liquid positioned in the chamber causing that the piston is forced away and that the diaphragm is ruptured as a consequence of the lacking support from the support surface 44. Thereby, there is established a connection between the discharge opening 36 and the discharged channel 62 so that the extinguishant liquid is discharged through the outlet stud 65 to the conduit 8 and the nozzle 6.

Figure 5:
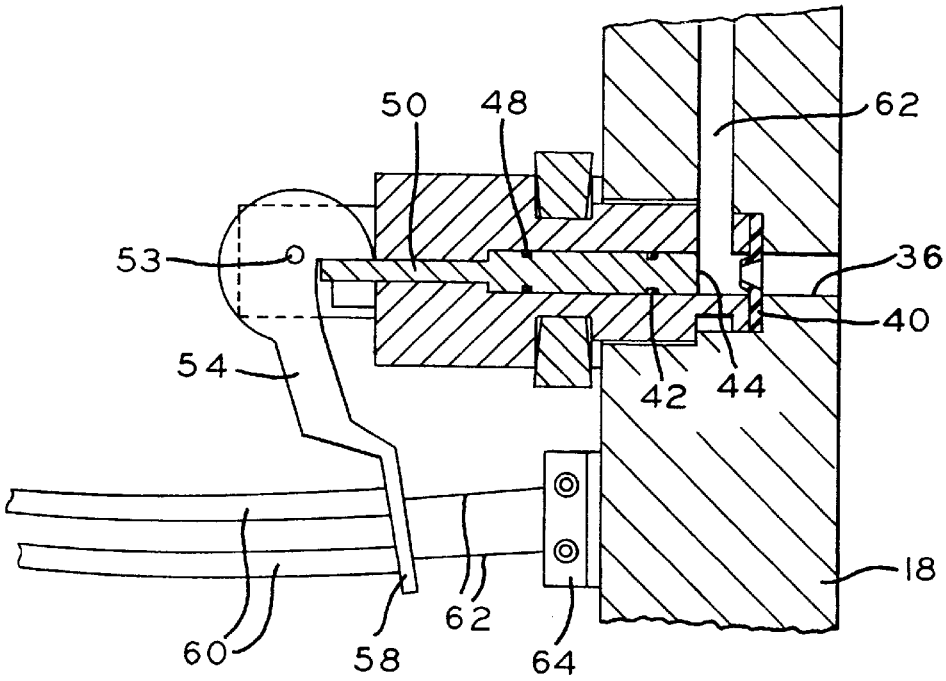
FIG. 5 is a section corresponding to FIG. 3 of the release valve of the fire extinguisher when the fire extinguisher is in the activated condition according to FIG. 4.
Figure 4:
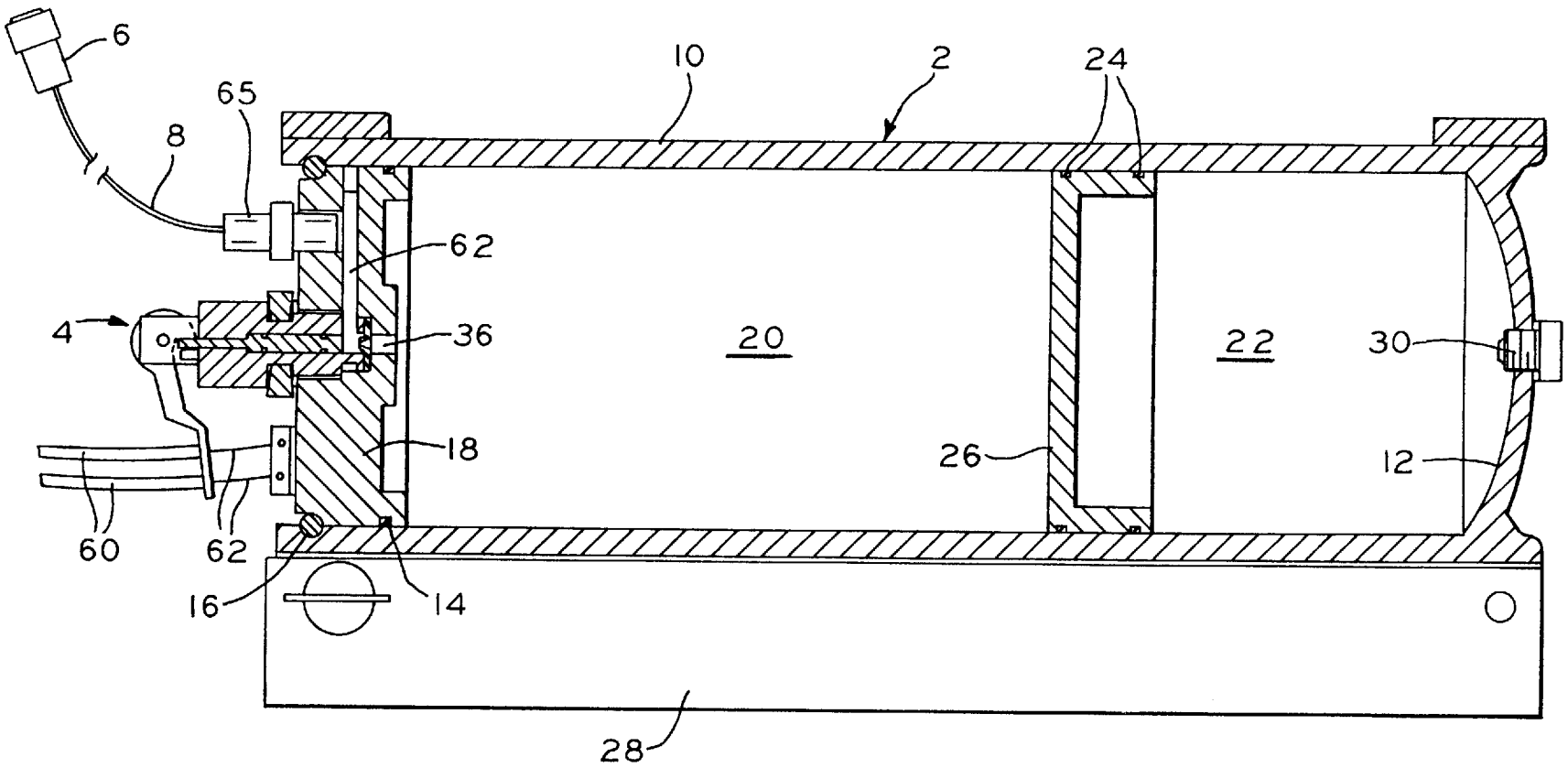
FIG. 4 shows the fire extinguisher according to FIG. 1 and 2 in an activated condition.

In FIG. 4 and 5 the fire extinguisher is shown after activation of the release valve 4. As appears from FIG. 4, the piston 26 has been displaced somewhat to the left as a consequence of the influence of the pressure from the gas pressurized in the chamber 22 and by means of the piston driving out the extinguishant liquid from the chamber 20. In a suitable embodiment of the invention about half of the total amount of extinguishant liquid is discharged during the first third of the total discharging time.

After the fire extinguisher has been emptied it is provided with a new diaphragm 40 whereupon the fire extinguisher can be charged in the same way as previously described.

Figure 6:
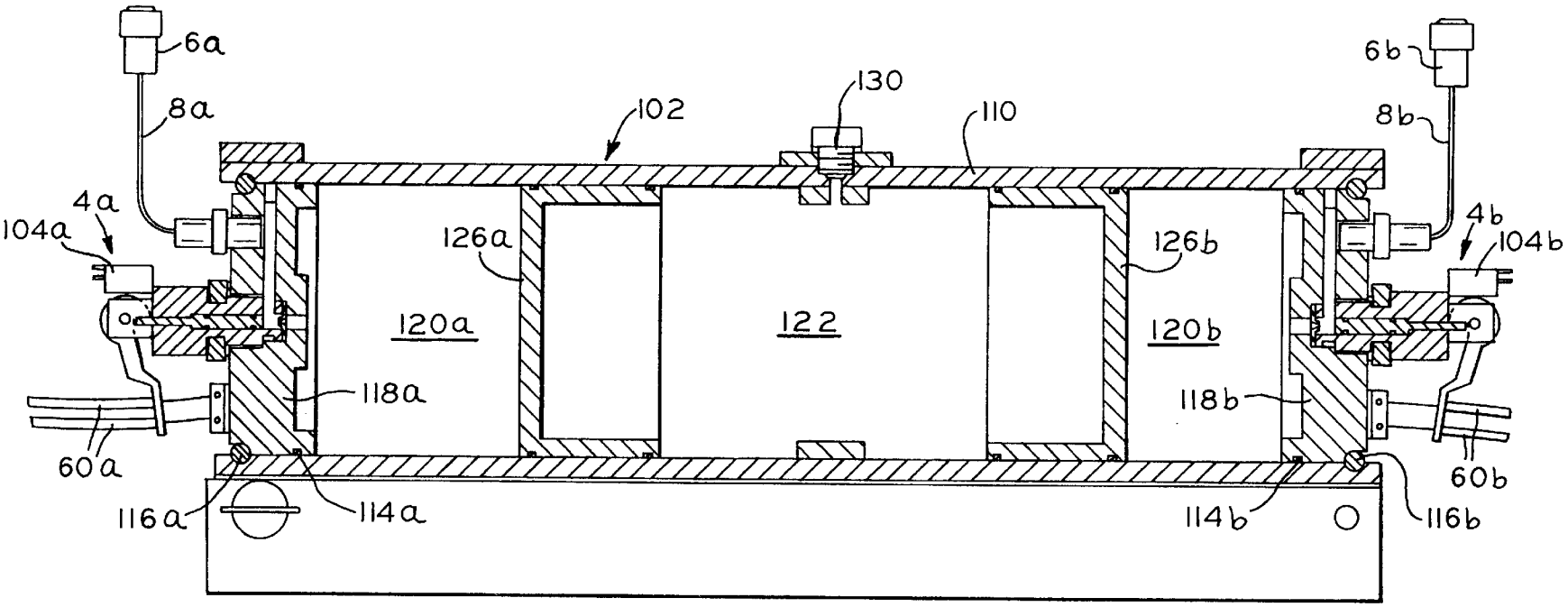
FIG. 6 shows a modified embodiment of the fire extinguisher according to the invention in a activated condition.

FIG. 6 shows a modified embodiment of the fire extinguisher according to the invention. Like the embodiment according to FIGS. 1–5 the fire extinguisher comprises a pressure container 102 having a cylindrical wall 110. However, in the embodiment according to FIG. 6 the pressure container 102 has two end walls 118*a* and 118*b* connected with the cylindrical wall 110 by means of seals 114*a* and 114*b* and locking rings 116*a* and 116*b*. In addition thereto the pressure container 102 is divided into three chambers, two chambers 120*a* and 120*b* for extinguishant liquid and an intermediate chamber 122 for driving gas.

The chambers 120*a* and 120*b* for extinguishant liquid has one release valve 4*a* and 4*b* each. The valves 4*a* and 4*b* are constructed in the same way as the valve 4 of the embodiment according to FIG. 1. The chamber 122 for driving gas is provided with a charging valve 130, and each chamber 120*a* and 120*b* has a charging valve (not shown) for extinguishant liquid. One conduit 8*a* and 8*b* having a nozzle 6*a* and 6*b* respectively, is connected with each end wall 118*a* and 118*b*, respectively.

The release valves 4*a* and 4*b* are provided with one set each of release wires 60*a* and 60*b*, respectively, in the same way as the release valve 4 according to FIG. 1.

The fire extinguisher shown in FIG. 6 can be used for example in a vehicle, the chambers 120*a* and 120*b* being thereby connected with vehicle spaces of different size, and the amount of extinguishant liquid in each chamber can thereby be adapted to the size of the different spaces. For the rest, the fire extinguisher according to FIG. 6 is operated in the same way as the fire extinguisher according to FIG. 1. In the case that the fire extinguisher is intended to be used for vehicles it is suitable that it is provided with contact means 104*a* and 104*b* connected with the release valves 4*a* and 4*b*, respectively, and connected with the petrol pump of the vehicle for switching off the pump, when the release valves are activated.

Figure 7:
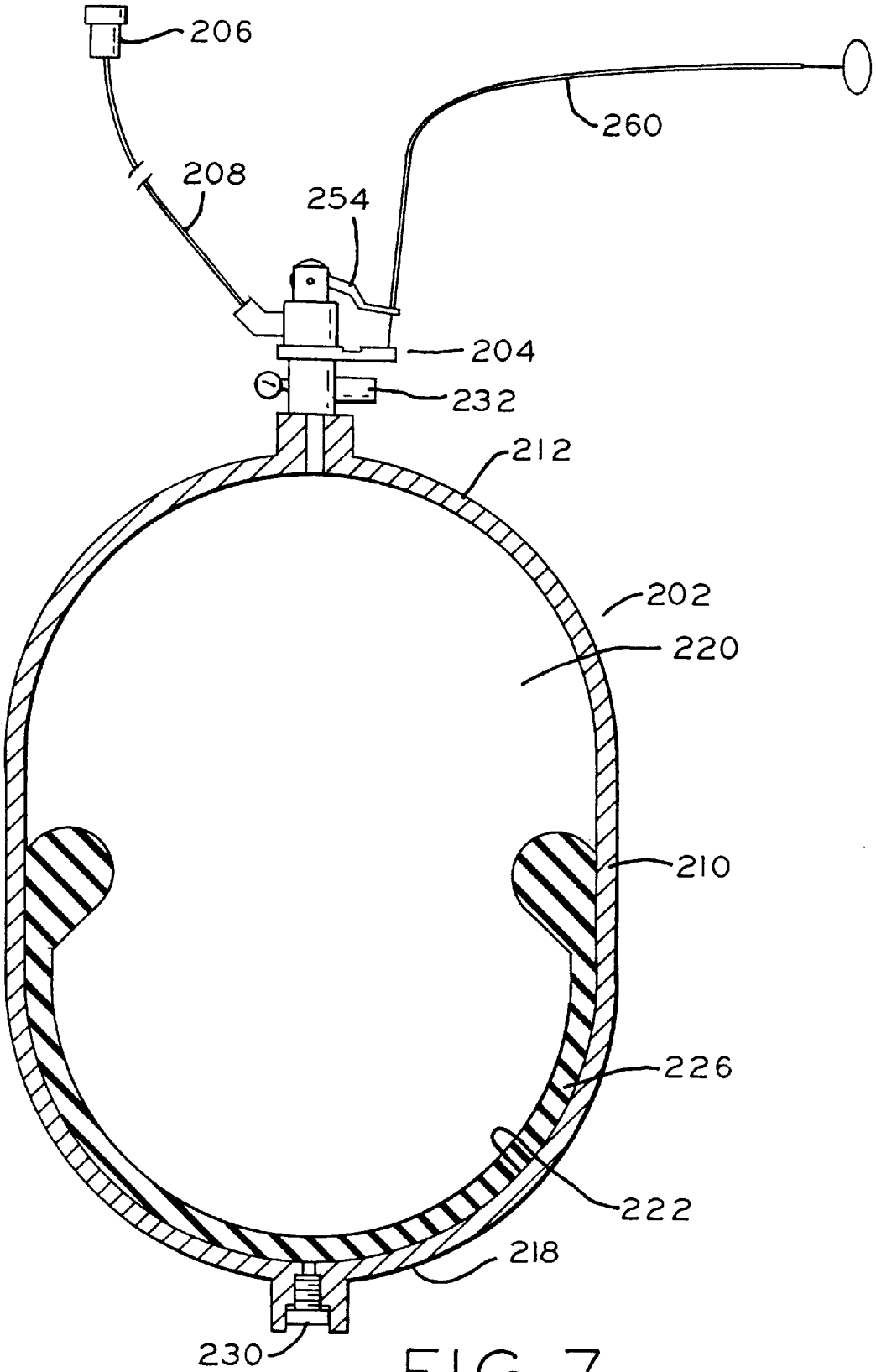
FIG. 7 shows a further embodiment of the fire extinguisher according to the invention in a charged but not activated condition.

The embodiment of a fire extinguisher according to the invention shown in FIG. 7 comprises a pressure container 202 constituted by a rigid outer wall having a cylindrical central portion 210 and end walls 212 and 218 formed in one piece therewith. In the pressure container there is positioned a bladder 226 formed by a flexible diaphragm wall and defining a chamber 222 for driving gas. Outside the bladder 226 the pressure container forms a chamber 220 for extinguishant liquid. To the chamber 222 there is connected a release valve 204 of principally the same construction as the release valve 4 in the embodiment of the fire extinguisher according to FIG. 1. To the release valve 204 there is connected a conduit 208 having a nozzle 206 of the same design as the nozzle 6 in the embodiment according to FIG. 1. To a release lock 254 positioned on the release valve 204 there is connected a release wire 260 as in the embodiment according to FIG. 1.

Charging of driving gas to the bladder 226 is provided through a charging valve 230 positioned in the end wall 218 of the pressure container, while the charging of extinguishant liquid takes place through a charging nipple 232 positioned in connection with the release valve 204.

Charging of the fire extinguisher according FIG. 7 is provided by first filling the bladder 222 with driving gas through the charging valve 30 to a pressure of 20 bar, whereupon the charging valve 230 is closed and extinguishant liquid is charged through the charging nipple 232 to a pressure of 100 bar under compression of the driving gas in the chamber 222 of the bladder 226. When the charging nipple 232 has been closed the fire extinguisher is ready for use.

When the release valve 204 is activated by means of the release wires 260 the release valve is activated in the same way as the valve of the embodiment according to FIG. 1, the estinguishant liquid being forced out from the pressure container 202 by the driving gas and being discharged as a liquid fog through the nozzle 206.

In FIG. 8 there is shown a fire extinguisher of the kind shown in FIG. 1 intended for extinguishing fires in vehicles. Thus, the fire extinguisher has a pressure container 2 having a release valve 4, release wires 60 and a conduit 8. The conduit 8 merges into a distribution system 66 in which the system branches to three pairs of nozzles 68, 70, and 72. The release valve 4 is provided with contact means 73 for switching off the fuel pump of the vehicle when the valve 4 is released.

FIGS. 9*a* and 9*b* show the fire extinguisher illustrated in FIG. 8 mounted in a vehicle. The pressure container 1 is positioned on the floor of the vehicle at the rear part of the vehicle, and from the pressure container the conduit system extends in such a way that two nozzles 68 are positioned in the front part of the coupe, two nozzles 70 are positioned in the ceiling of the coupe and two nozzles 72 are positioned in the motor space of the vehicle. It can be suitable also to position two nozzles in connection with the petrol tank of the vehicle.

In FIG. 10 there is shown an embodiment of the fire extinguisher according to the invention which is suitable for being positioned in the motor space of a boat. To the pressure container 2 having a release valve 4 of the same kind as the release valve 4 in the embodiment according to FIG. 1 and a release wire 60 connected with the release valve there is connected a conduit 8 having a distribution system 74 being provided with three nozzles 76. Also in this embodiment the release valve 4 is provided with contact means 73 for shutting off the petrol pump of the vehicle when the valve 4 is activated.

In FIG. 11 there is shown the connection of the fire extinguisher 10 to a box 78 in which a motor box 80 is positioned. The motor box 80 is intended to contain an inboard motor for a boat.

The invention can be modified within the scope of the following claims.

I claim:

1. A fire extinguisher for closed spaces, said fire extinguisher comprising a pressure container having first and second fluid storage chambers therein, said first and second fluid storage chambers separated from each other and partially defined by a displaceable wall, an extinguishant liquid stored in said first chamber, said first chamber provided with a release valve, a pressurized driving gas stored in said second chamber, the extinguishant liquid stored in said first chamber discharged through said release valve by displacement of said displaceable wall into the first chamber at a high pressure in response to a driving force exerted on said displaceable wall by said pressurized driving gas stored in said second chamber upon actuation of said release valve, the fire extinguisher further comprising at least one nozzle connected with the release valve, the extinguishant liquid supplied to the nozzle from the release valve at a high pressure atomized by said nozzle, a liquid fog created by said atomized extinguishant liquid filling the closed space, wherein the displaceable wall is constituted by a piston displaceably positioned in the pressure container between the first chamber containing the extinguishant liquid and the second chamber containing the pressurized driving gas, the piston being adapted to discharge the whole amount of extinguishant liquid from the fire extinguisher.

2. A fire extinguisher according to claim 1, characterized in that the release valve comprises a discharge opening which is closed by means of a diaphragm supported at the side opposite from the first chamber by a displaceable support element, the support element being adapted at the activation of the release valve to be displaced from its position in which it supports the diaphragm and the diaphragm being adapted in the position in which it is not supported by the support element to be ruptured by the extinguishant liquid which is thereupon discharged from the pressure container through the discharge opening of the release valve.

3. A fire extinguisher according to claim 1, characterized in that the extinguishant liquid is constituted substantially by water.

4. A fire extinguisher according to claim 3, characterized in that the water contains an agent for reducing its surface tension.

5. A fire extinguisher according to claim 1, characterized in that the pressure of the extinguishant liquid and the pressurized driving gas prior to the activation of the release valve amounts to about 100 bar and that the pressure during the discharge of the extinguishant liquid from said pressure container in average amounts to 70 bar.

6. A fire extinguisher according to claim 5, characterized in that the nozzle is adapted to form a liquid fog having a droplet size of 15–80 $\mu$m.

7. A fire extinguisher according to claim 6, characterized in that several nozzles are connected with the first chamber of the pressure container and the nozzles are positioned in any one of the motor space of a vehicle, in the coupe of the vehicle or in connection with the petrol tank of the vehicle.

8. A fire extinguisher according to claim 1, characterized in that several nozzles are connected with the first chamber of said pressure container and the nozzles are positioned in any one of the motor space of a vehicle, in the coupé of the vehicle or in connection with the petrol tank of the vehicle.

9. A fire extinguisher for closed spaces comprising a pressure container having at least two chambers separated from each other by means of a displaceable wall, one of the first chambers containing an extinguishant liquid and being provided with a release valve and the second chamber containing a pressurized driving gas for discharging the extinguishant liquid from said first chamber through said release valve by displacing the displaceable wall into the first chamber at a high pressure when the release valve is actuated, the fire extinguisher further comprising at least one nozzle connected with the release valve for atomizing the extinguishant liquid supplied to the nozzle from the release valve at a high pressure in order to create a liquid fog filling the closed space, said displaceable wall constituted by a piston displaceably positioned in the pressure container between the first chamber containing the extinguishant liquid and the second chamber containing the pressurized driving gas, the piston being adapted to discharge the whole amount of extinguishant liquid independent of the fire extinguisher, said pressure container comprising two chambers for extinguishant liquid comprising one release valve each and a chamber for pressurized driving gas positioned between said chambers and separated therefrom by means of displaceable walls.

10. A fire extinguisher according to claim 9, characterized in that the two chambers for extinguishant liquid contain different amounts of extinguishant liquid.

11. A fire extinguisher according to claim 10, characterized in that the release valve comprises a discharge opening which is closed by means of a diaphragm supported at the side opposite from the first chamber by a displaceable support element, the support element being adapted at the activation of the release valve to be displaced from its position in which it supports the diaphragm and the diaphragm being adapted in the position in which it is not supported by the support element to be ruptured by the extinguishant liquid which is thereupon discharged from the pressure container through the discharge opening of the release valve.

12. A fire extinguisher according to claim 11, characterized in that the support element is constituted by a position displaceably journalled in the release valve and contacting in its position for supporting the diaphragm the diaphragm with an end surface.

13. A fire extinguisher according to claim 12, characterized in that the release valve has a rotatably arranged release lock contacting with a locking surface a piston rod connected with the position for securing the piston in the position supporting the diaphragm when the release valve is not activated, the release lock being adapted at the activation of the release valve to be rotated to a position for releasing the piston.

14. A fire extinguisher according to claim 13, characterized in that the release lock is rotatably journalled on a shaft pin which is displaced from the axis of the piston rod for providing a pretension of the release lock towards the secured position.

15. A fire extinguisher according to claim 14, characterized in that the extinguishant liquid is constituted substantially by water.

16. A fire extinguisher according to claim 15, characterized in that the water contains an agent for reducing its surface tension.

17. A fire extinguisher according to claim 16, characterized in that the pressure of the extinguishant liquid and the pressurized driving gas prior to the activation of the release valve amounts to about 100 bar and that the pressure during the discharge of the extinguishant liquid from the pressure container in average amounts to 70 bar.

18. A fire extinguisher according to claim 17, characterized in that the nozzle is adapted to form a liquid fog having a droplet size of 15–80 $\mu$m.

19. A fire extinguisher according to claim 18, characterized in that several nozzles are connected with said first chamber of said pressure container and the nozzles are positioned in any one of the motor space of a vehicle, in the coupe of the vehicle or in connection with the petrol tank of the vehicle.

20. A fire extinguisher according to claim 9, characterized in that the release valve comprises a discharge opening which is closed by means of a diaphragm supported at the side opposite from a said first chamber by a displaceable support element, the support element being adapted at the activation of the release valve to be displaced from its position in which it supports the diaphragm and the diaphragm being adapted in the position in which it is not supported by the support element to be ruptured by the extinguishant liquid which is thereupon discharged from the pressure container through the discharge opening of the release valve.

* * * * *